US007004781B2

(12) United States Patent
Walter

(10) Patent No.: US 7,004,781 B2
(45) Date of Patent: Feb. 28, 2006

(54) TERMINAL

(75) Inventor: Frank Walter, Blumberg (DE)

(73) Assignee: RIA-BTR Produktions GmbH, Blumberg (DE)

( * ) Notice: Subject to any disclaimer, the term of this patent is extended or adjusted under 35 U.S.C. 154(b) by 0 days.

(21) Appl. No.: 10/855,849

(22) Filed: May 27, 2004

(65) Prior Publication Data

US 2004/0248457 A1 Dec. 9, 2004

(30) Foreign Application Priority Data

Jun. 6, 2003 (DE) ..... 203 08 863 U

(51) Int. Cl.
*H01R 11/20* (2006.01)
*H01R 4/20* (2006.01)
*H01R 4/24* (2006.01)

(52) U.S. Cl. ..... 439/441; 439/268

(58) Field of Classification Search ..... 439/439–441, 439/266–268

See application file for complete search history.

(56) References Cited

U.S. PATENT DOCUMENTS

| | | | | |
|---|---|---|---|---|
| 6,074,241 | A * | 6/2000 | Patel et al. | 439/441 |
| 6,146,217 | A * | 11/2000 | Osada | 439/835 |
| 6,250,950 | B1 * | 6/2001 | Pallai | 439/441 |
| 6,682,364 | B1 * | 1/2004 | Cisey | 439/441 |
| 6,851,967 | B1 * | 2/2005 | Miyoshi et al. | 439/441 |

FOREIGN PATENT DOCUMENTS

| | | | |
|---|---|---|---|
| DE | 41 02 784 | A1 | 8/1992 |
| EP | 0 735 616 | A2 | 10/1996 |
| JP | 2001160431 | A * | 6/2001 |

* cited by examiner

*Primary Examiner*—Michael C. Zarroli
(74) *Attorney, Agent, or Firm*—Muirhead and Saturnelli, LLC

(57) ABSTRACT

A terminal for circuit boards is described, having at least one clamping contact situated in a housing. The clamping contact is composed of a contact element and a clamping spring, the clamping spring being operable via an operating element. A projection is situated on the operating element, the projection striking a stopping edge of the housing in the position of the operating element causing the clamping spring to open. A counter-projection is situated on the side of the operating element opposite the projection, the counter-projection striking an interior stopping edge of the housing in the position of the operating element causing the clamping spring to be clamped.

9 Claims, 2 Drawing Sheets

TERMINAL

FIELD OF THE INVENTION

The present invention relates to a terminal for circuit boards and a method of using the same.

BACKGROUND OF THE INVENTION

An electric terminal for a circuit board, having an insulating housing and a contact spring situated therein, is known from EP 0 735 616 A2. When the terminal is attached to the circuit board, the contact end of the contact spring is prestressed against a contact area of the circuit board. The terminal end of the contact spring facing away from the contact end is electrically connectable to a conductor assigned to the contact spring. The spring force makes the terminal end of the contact spring, which is simultaneously used for fixing the conductor in the terminal, directly electrically contact the conductor. Thus, the conductor must be pushed between the terminal end and the housing only against the spring force of the contact spring and is fixed by the clamping effect.

An electric terminal for connecting multiple electric conductors in which the contact spring may be brought into an opened and a closed state via an operating element is known from DE 41 02 784 A1. When the operating element is pushed into the housing, it is in the opened state, thereby pushing the contact spring into an opened state, so that the conductor to be connected may be inserted into the housing without resistance. No pressure is exerted on the operating element in its closed state, so that the operating element is pushed out of the housing by the spring force while the contact spring closes, fixing the conductor by the clamping effect.

Such an operating element has the disadvantage that an excessive pressure may push the operating element completely into the housing, so that the contact spring can no longer close. On the other hand, an excessive tension of the contact spring may push the operating element out of the housing.

Accordingly, it is desirable to provide an improved embodiment of the operating element for a terminal, which does not exhibit the disadvantages mentioned.

SUMMARY OF THE INVENTION

According to one aspect of the present invention, a terminal is provided that includes an operating element with a projection which strikes a stopping edge of the housing in the opened state of the operating element. It is thus not possible to push the operating element into the housing farther than the stop, the distance covered, however, being sufficient to open the clamping spring to a degree such that the electric conductor may be inserted into the housing without resistance.

A counter-projection, which strikes an interior stopping edge of the housing in the closed state of the operating element, is advantageously situated on the side of the operating element opposite the projection. This additionally prevents the clamping spring from pushing the operating element out of the housing.

The operating element advantageously has a bevel, which, in the closed state of the operating element, is in flush contact with a beveled surface of the housing. The operating element is thus guided in a targeted manner, thereby preventing undesirable displacements of the operating element.

A plug-in contact for attachment on a multi-pin connector is advantageously situated on the contact element. The connection of the terminal to the multi-pin connector is thus established in a particularly simple manner.

In one embodiment of the present invention, the operating element is a one-piece injection molded part made of plastic. The operating element may thus be manufactured in a particularly simple and cost-effective manner.

BRIEF DESCRIPTION OF THE DRAWING

Exemplary embodiments of the present invention are explained in greater detail on the basis of the following drawing, in which.

DETAILED DESCRIPTION OF VARIOUS EMBODIMENTS

Figure 2:
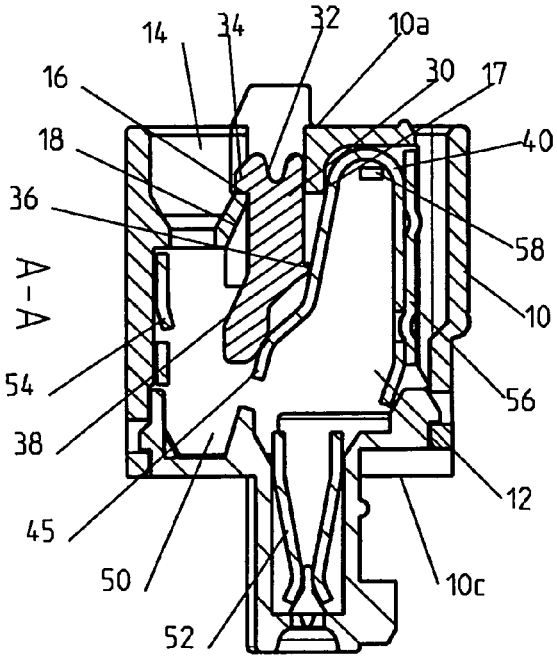
FIG. 2 shows a corresponding cross section through the terminal including the operating element in its opened state.

Referring now to the figures of the drawing, the figures constitute a part of this specification and illustrate exemplary embodiments of the invention. It is to be understood that in some instances various aspects of the invention may be shown exaggerated or enlarged to facilitate an understanding of the invention.

Figure 1:
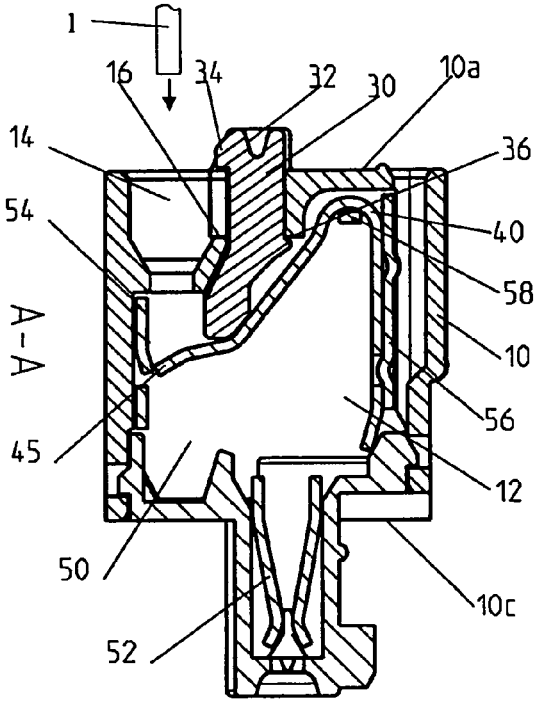
FIG. 1 shows a cross section of a terminal including an operating element in its closed state according to line A—A in FIG. 3.

FIGS. 1 and 2 show a cross section through a terminal including a housing 10, having a chamber 12 which is provided with a plug-in opening 14 on front face 10*a* of housing 10, through which a conductor may be inserted into the interior of housing 10.

A contact element 50 is attached to one closed side face 10*b* of chamber 12, the contact element having two legs 54, 56 which are in contact with the side faces of chamber 12. Furthermore, a plug-in contact 52 is molded on contact element 50 forming one piece, the plug-in contact protruding through an opening on rear side 10*c* of housing 10. When housing 10 of the terminal is attached to a multi-pin connector (not shown), plug-in contact 52 engages the contact pins, thereby establishing an electric contact between the terminal and the multi-pin contactor.

An approximately U-shaped clamping spring 40 is situated in chamber 12. One leg of U-shaped clamping spring 40 is in contact with the inside of leg 56 of contact element 50. The other leg of clamping spring 40 is bent in such a way that it runs approximately across in front of plug-in opening 14 of housing 10, the end of the leg as clamping end 45 being in resilient contact with second leg 54 of contact element 50. In order to keep clamping spring 40 in its position in chamber 12 of housing 10, the bend of U-shaped clamping spring 40 is inserted between the housing wall and a projection 58 that is molded on contact element 50.

An operating element 30, which may be pushed into housing 10 against the spring force of clamping spring 40, is inserted into housing 10 next to plug-in opening 14. On its outward facing edge, operating element 30 has a notch 32 into which, for example, a screwdriver (not shown) may be inserted to effortlessly push operating element 30 into housing 10, while operating element 30 pushes clamping end 45 of clamping spring 40 away from leg 54 of contact element

50 into the opened position in which it opens a gap, into which the electric conductor 1 may be inserted through plug-in opening 14 into chamber 12 of housing 10. On the end protruding from housing 10, operating element 30 has a projection 34 whose bottom side, facing housing 10, runs parallel to front face 10*a* of housing 10. If operating element 30 is pushed into housing 10, the bottom side of projection 34 of operating element 30 strikes a stopping edge 16 of housing 10 after a certain distance, thereby preventing operating element 30 from being further pushed into housing 10 (see FIG. 2).

Figure 5:
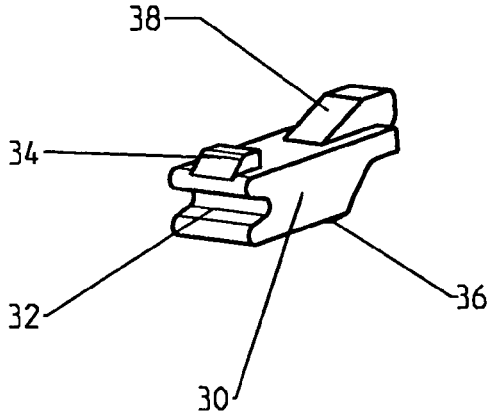
FIG. 5 shows a perspective view of the operating element.

If operating element 30 is released, clamping spring 40 resiliently moves back and, using clamping end 45, clamps the electric conductor to leg 54 of contact element 50. In this way, clamping end 45 of clamping spring 40 pushes operating element 30 in housing 10 outward into the closed position. On the side on which projection 34 is situated, operating element 30 has a bevel 38 (see FIG. 5) which aligns operating element 30 parallel to the side faces of chamber 12 during the movement out of housing 10. Bevel 38 of operating element 30 then comes to rest on a beveled surface 18 of housing 10.

A counter-projection 36 is situated on the side of operating element 30 opposite bevel 38 and projection 34. During the movement of operating element 30 out of the housing, counter-projection 36 strikes an interior stopping edge 17 of housing 10, thereby preventing operating element 30 from being pushed out of housing 10 by the spring force of clamping spring 40.

Figure 3:
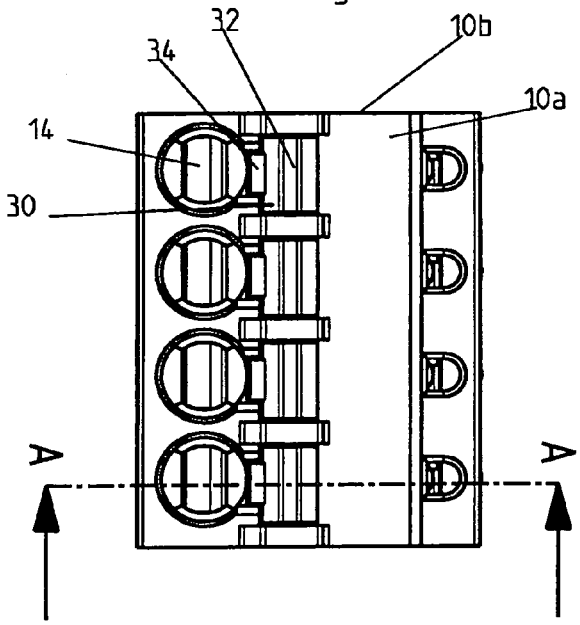
FIG. 3 shows a front view of a multi-pole terminal.
Figure 4:
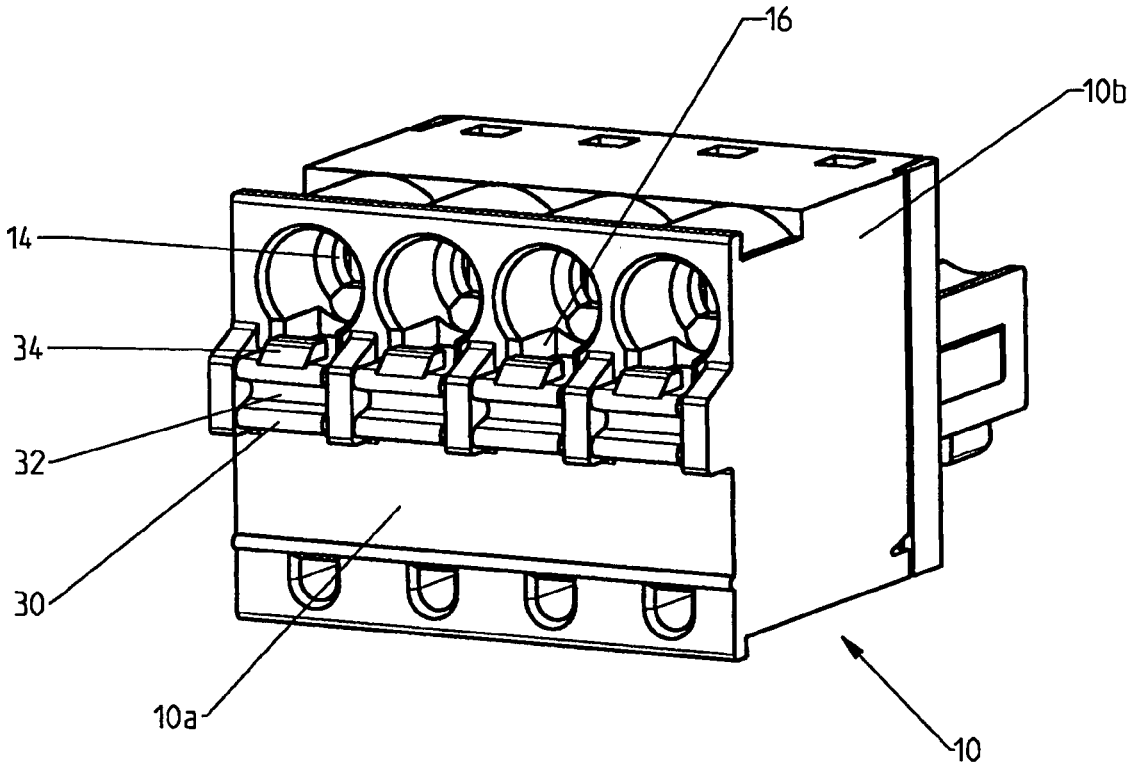
FIG. 4 shows a perspective view of the multi-pole terminal.

FIGS. 3 and 4 show a top view of front face 10*a* and a perspective view of a quadrupole terminal. Of course, the terminal may also have more or less clamping contacts, or, via suitable tongue and groove connections, the individual terminals may be assembled module-style to form a longer terminal.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A terminal for a circuit board, comprising:

at least one clamping contact situated in a housing, the clamping contact including a contact element and a clamping spring, wherein the clamping spring is operable via an operating element, and wherein a projection is situated on the operating element, the projection striking a stopping edge of the housing in the position of the operating element causing the clamping spring to open, wherein the operating element has a bevel which is in flush contact with a beveled surface of the housing in the position of the operating element causing the clamping spring to be clamped.

2. The terminal as recited in claim 1, further comprising a counter-projection situated on the side of the operating element opposite the projection, the counter-projection striking an interior stopping edge of the housing in the position of the operating element causing the clamping spring to be clamped.

3. The terminal as recited in claim 1, further comprising a plug-in contact situated on the contact element for attachment to a multi-pin connector.

4. The terminal as recited in claim 1, wherein the operating element is a one-piece injection molded part made of plastic.

5. A terminal, comprising:

a housing;

a clamping element disposed in said housing;

an operating element that penetrates said housing and engages said clamping element, wherein said operating element includes a first projection that strikes a first stopping edge of the housing and stops said operating element in a first position that moves said clamping element into an open position, and a second projection disposed on said operating element, wherein said second projection strikes a second stopping edge of said housing when said operating element is moved outward from said housing and stops said operating element in a second position that allows said clamping element to move into a clamped position; and a contact element disposed in said housing, wherein said contact element includes a first portion and a second portion, and wherein said first portion of said contact element contacts a first part of said clamping element.

6. The terminal as recited in claim 5, wherein movement of said operating element causes a second part of said clamping element to move between said open position and said clamped position and wherein said second part of said clamping element clamps a conductor inserted into said housing against said second portion of said contact element when said clamping element is in said clamped position.

7. The terminal as recited in claim 5, wherein the operating element includes a bevel which contacts a beveled surface of the housing in a second position of the operating element that allows said clamping element to move into a clamped position.

8. The terminal as recited in claim 5, further comprising:

a connector that protrudes into said housing and contacts a conductor inserted into said housing.

9. The terminal as recited in claim 5, wherein the operating element is a one-piece injection molded part made of plastic.

* * * * *